United States Patent [19]

Surjaatmadja et al.

[11] Patent Number: 5,056,600

[45] Date of Patent: Oct. 15, 1991

[54] CONTROL APPARATUS AND METHOD RESPONSIVE TO A CHANGING STIMULUS

[75] Inventors: Jim B. Surjaatmadja, Duncan, Okla.; Bill W. White, Sandy, Utah

[73] Assignee: Halliburton Company, Duncan, Okla.

[21] Appl. No.: 520,702

[22] Filed: May 7, 1990

[51] Int. Cl.[5] ..... E21B 34/08; E21B 43/12; E21B 47/06

[52] U.S. Cl. ..... 166/373; 166/53; 166/250; 166/264; 137/625.66; 251/47

[58] Field of Search ..... 137/625.66; 251/47, 251/48; 166/53, 373, 374, 375, 66.4, 65.1, 250

[56] References Cited

U.S. PATENT DOCUMENTS

| | | | |
|---|---|---|---|
| 4,079,784 | 3/1978 | Howard et al. | 166/53 X |
| 4,559,970 | 12/1985 | Taylor et al. | 137/625.66 X |
| 4,746,423 | 5/1988 | Moyer | 166/53 X |
| 4,747,451 | 5/1988 | Adams et al. | 166/53 |
| 4,796,699 | 1/1989 | Upchurch | 166/53 X |

*Primary Examiner*—Stephen J. Novosad
*Attorney, Agent, or Firm*—James R. Duzan; E. Harrison Gilbert, III

[57] ABSTRACT

A control system and method utilizing a race between two responses to a changing stimulus are disclosed. An example of a changing stimulus is pressure which increases at a decreasing rate of change during a closed-in period of a drill stem test in an oil or gas well. In a preferred embodiment two components are moved in different directions, but in a net first direction, until the rate of change of the pressure is sufficiently low (e.g., near steady state), at which time the rates of movement of the two components produce net movement in a second direction. In a preferred embodiment, the change in direction of the net movement moves a control valve which communicates a pressure control signal for opening a bypass valve to commence a flow period of the drill stem test.

18 Claims, 3 Drawing Sheets

CONTROL APPARATUS AND METHOD RESPONSIVE TO A CHANGING STIMULUS

BACKGROUND OF THE INVENTION

This invention relates generally to a control apparatus responsive to a changing stimulus, and it also relates generally to a method of producing a control response to a changing stimulus. This invention relates more particularly, but not by way of limitation, to an apparatus for controlling the opening of a valve disposed in a tubing string in a well during a drill stem test wherein the valve is opened during a flow period of the test and closed during a shut-in period of the test. This invention also relates more particularly, but not by way of limitation, to a method of opening a bypass valve during a drill stem test.

Various stimuli can be monitored to produce a desired response. Voltage, current and frequency are examples of electrical stimuli. Chemical reactions can also be stimuli, as can mechanical phenomena such as the speed of a object. Pressure is another type of stimulus which is sometimes monitored to produce a response.

A stimulus has an identifiable characteristic, such as magnitude or rate of change, which can be detected to produce the response. For example, the rate of change of pressure is an identifiable or detectable characteristic. The rate of pressure change in an oil or gas well will be used as a specific example.

During the development of an oil or gas well, a drill stem test might be performed to determine pressure characteristics which provide important information about the ability of the well to produce hydrocarbons. During a drill stem test, a valve is opened and closed to define flow and shut-in periods during which hydrocarbons are allowed to flow to the surface or stopped from doing so. Stopping the flow allows the pressure to build up in the well. To perform a drill stem test efficiently, a suitable end of each shut-in period needs to be identified so that a valve can be opened to permit flow. During a flow period the pressure decreases to a minimum. This flow condition can generally be detected at the mouth of the well by an operator who can manually cause the valve to be closed after some time period as desired. During a closed-in, or shut-in, period, however, the pressure is not communicated to the surface so that some means is needed by which to know when to open the valve. Typically, the valve should be opened when the pressure is increasing slowly enough to indicate that steady-state maximum pressure has almost been reached (although steady state may not have actually been reached, this condition is taken as indicative of steady state and thus will be referred to as a steady-state condition). Opening the valve before this condition is reached can produce erroneous or incomplete data, and delaying opening of the valve until well after this condition wastes testing time and money.

A drill stem test can be performed using a wire line tool whereby downhole pressure is monitored and data signals are immediately transmitted to the surface on the wire line cable on which the tool is suspended in the well. This gives the operator real-time information from which he knows when to open the valve; however, wire lines have disadvantages well known in the industry. For example, there can be installation problems; the wire can break, causing time to be lost while retrieving the tool; and there can be fire and explosion hazards.

Another previous technique for performing drill stem tests includes installing pressure gauges at the bottom of a drill string. The drill string also has the necessary porting valves that can be opened and closed from the surface to establish the flow and closed-in periods necessary for the tests. Although these gauges can collect the information, they do not transmit the information to the surface on a real-time basis; therefore, this type of system does not help in determining how long the shut-in periods should be maintained. That is, without the real time information which can be provided via a wire line type of system, a shut-in period might not be maintained long enough, thereby possibly resulting in an invalid or unanalyzable test, or maintained too long, thereby unnecessarily prolonging the test and unnecessarily increasing rig time costs.

For the specific example of needing to determine when pressure reaches a steady-state condition during a shut-in period of a drill stem test, there is the need for an improved apparatus and method for sensing and providing a control signal in response to a steady-state condition of changing pressure during the shut-in period. In particular, there is the need for an apparatus and method for use downhole in a well to monitor pressure and control automatically a bypass valve to define more efficiently the end of a shut-in period and the start of a flow period of a drill stem test. Although there are these specific needs, there is also the broader need for such an apparatus and method to be applicable more generally to a control apparatus and method for producing a control response to a changing stimulus.

SUMMARY OF THE INVENTION

The present invention overcomes the above-noted and other shortcomings of the prior art by providing a novel and improved control apparatus responsive to a changing stimulus and a novel and improved method of producing a control response to a changing stimulus. In a particular embodiment the present invention provides an apparatus for controlling the opening of a valve disposed in a tubing string in a well during a drill stem test wherein the valve is opened during a flow period of the test and closed during a shut-in period of the test. The present invention also provides a method of opening a bypass valve during a drill stem test.

The present invention utilizes relative rates or responses to produce a control response to a changing stimulus. The changing stimulus creates or initiates a race between two or more responses or reactions. During the race, at least one response or reaction exceeds or surpasses the other(s) to create a net first result; however, ultimately the other(s) surpasses or predominates to create a net second result. The change from the first net result to the second net result produces the desired control.

In a particular implementation of the present invention, changing pressure in a well initiates a race between an outer cylinder and an inner piston. Initially, the outer cylinder outraces the inner piston to produce net movement in a first direction; ultimately, however, the inner piston rate of movement exceeds that of the outer cylinder whereby net movement in the other direction results and a control signal produced. In the particular embodiment, this provides real-time downhole control of a valve during a drill stem test without the need of a wire line apparatus. This control is produced automatically and efficiently so that closed-in periods are neither too short nor too long. Without being limiting of the invention, the particular implementation of the present invention senses a steady-state condition during a closed-in period and provides a control signal to open a valve to start a flow period during a drill stem test. Resetting in preparation for a subsequent operation occurs automatically during each flow period. This offers consistent tests with less failures due to insufficient closure time, and it also avoids unnecessarily lengthy tests.

A control apparatus responsive to a changing stimulus provided in accordance with the present invention comprises: means for producing a first response to a changing stimulus; means for producing a second response to the stimulus wherein the second response is initially masked by the first response; and means for producing a control signal in response to the second response surpassing the first response.

A method of producing a control response to a changing stimulus in accordance with the present invention comprises: producing a first response and a second response to a stimulus changing towards a steady-state condition; and combining the first and second responses into a net control response having at a first time a first state wherein the first response dominates the second response until the stimulus reaches the steady-state condition and having at a second time a second state wherein the second response dominates the first response in response to the stimulus reaching the steady-state condition.

Therefore, from the foregoing, it is general object of the present invention to provide a novel and improved control apparatus and method responsive to a changing stimulus. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENTS

The preferred embodiments of the present invention will be described with reference to controlling the opening of a bypass valve during a drill stem test. The changing stimulus responded to is pressure in the well bore, and more specifically, pressure changing at a varying rate.

Figure 1:
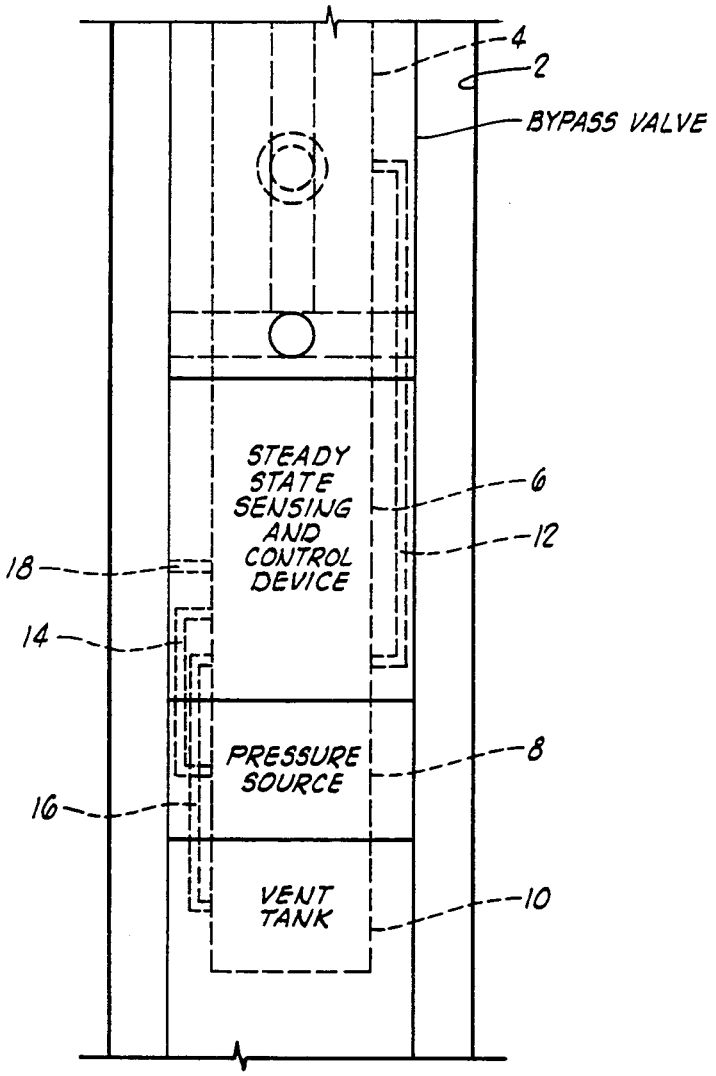
FIG. 1 is a schematic illustration of a preferred embodiment apparatus of the present invention for use in a drill stem test.

Referring to FIG. 1, the lower portion of a tubing string is shown disposed in a well 2. Connected in the tubing string is a conventional bypass valve 4 for use in drill stem tests. Also connected in the tubing string is the present invention, identified as a steady state sensing and control device 6. As particularly described herein, the device 6 is a mechanical device which communicates the bypass valve 4 either with a pressure source 8, such as pressurized nitrogen, or a vent tank 10. If desired, the vent tank 10 can be eliminated and the control gases released to the atmosphere through the tubing string. The communication shown in FIG. 1 is schematically illustrated by internal channels 12, 14, 16. The steady state sensing and control device 6 responds to well bore pressure which is received through the schematically illustrated port 18.

Figure 2:
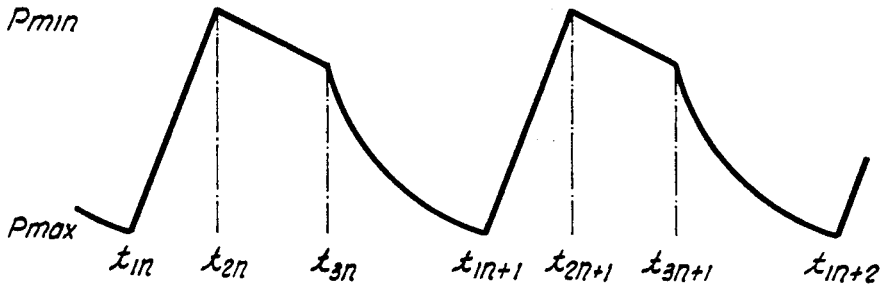
FIG. 2 is a graph illustrating a pressure response during a drill stem test having alternating flow and closed-in periods.

During a drill stem test, the bypass valve 4 is repeatedly opened and closed to flow and shut-in the well 2 below a packer or other known annulus sealing device (not shown). The well bore pressure monitored or detected during these cycles yields information about the ability of the well to produce. A characteristic representation of well bore pressure during a drill stem test is shown in FIG. 2.

Time $t_{1n}$ is the end of a closed-in period and the beginning of a flow period. This is the critical point with respect to what is achieved by the specific implementation of the present invention described herein. If the valve 4 is opened too soon, (i.e., $t_{1n}$ occurs too soon), a true or sufficiently representative well bore maximum pressure will not be recorded; whereas delaying $t_{1n}$ by opening the valve 4 past the time a sufficient maximum pressure is first reached wastes expensive rig time. Premature opening can also prevent enough total data being obtained. With the present invention, a time $t_{1n}$ is marked and the valve 4 opened automatically when a steady-state condition of the well bore pressure, thereby indicating sufficient maximum pressure or data collection, first occurs.

Once the valve 4 is opened, fluid from the well bore flows upwardly through the tubing string to the mouth of the well 2. During this flow, the well bore pressure decreases to a minimum. This occurs in FIG. 2 at time $t_{2n}$. A slight pressure increase occurs up to time $t_{3n}$. This flow is sensed at the surface because the well is in communication with the surface through the open valve 4. At a desired time, $t_{3n}$, the bypass valve 4 is closed via surface control in a manner known in the art.

Once the valve 4 has been closed, pressure increases from time $t_{3n}$ to the following valve opening time, $t_{1n+1}$. Because this pressure increase is isolated from detection at the surface (unless a wire line or other telemetry technique is used), there is the need for a device downhole to sense the pressure and to open the bypass valve at the appropriate time. The present invention does this by sensing when the well bore pressure reaches the aforementioned steady-state condition (i.e., small rate of pressure change) indicating that sufficient data has been obtained. Upon sensing this condition, the present invention communicates the pressure source 8 with the valve 4 to open the valve 4.

Figure 3:
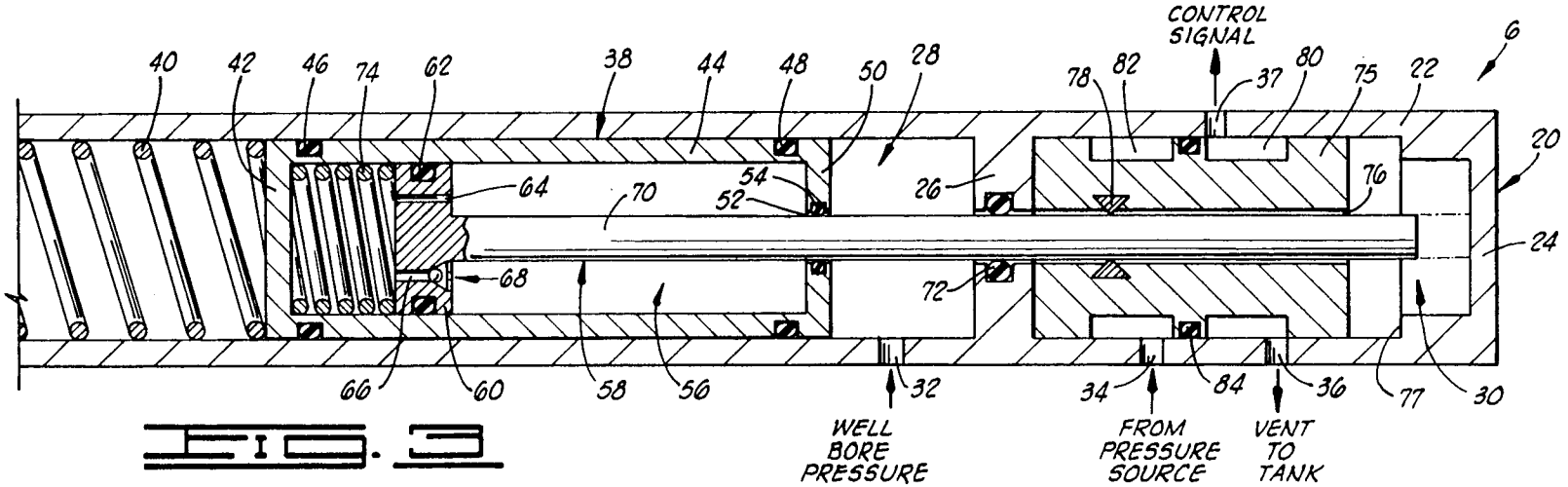
FIG. 3 is a schematic illustration of an apparatus shown at a position immediately after time $t_{3n}$ in FIG. 2.
Figure 4:
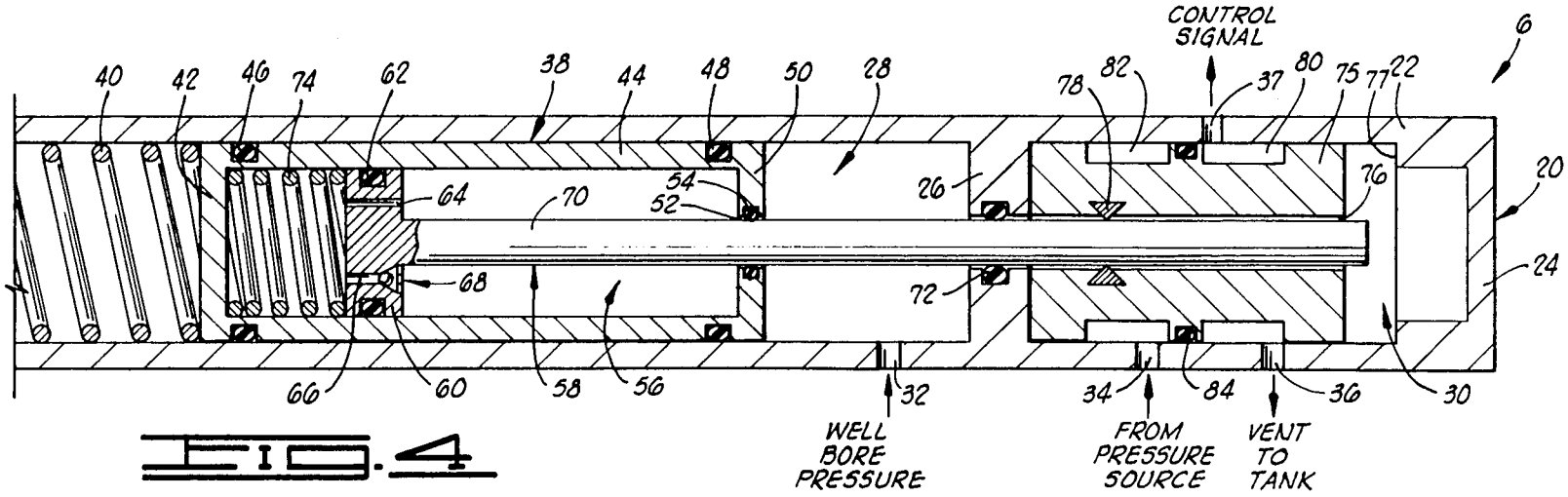
FIG. 4 is a schematic illustration of the apparatus shown at a time in between times $t_{3n}$ and $t_{1n+1}$ shown in FIG. 2.
Figure 5:
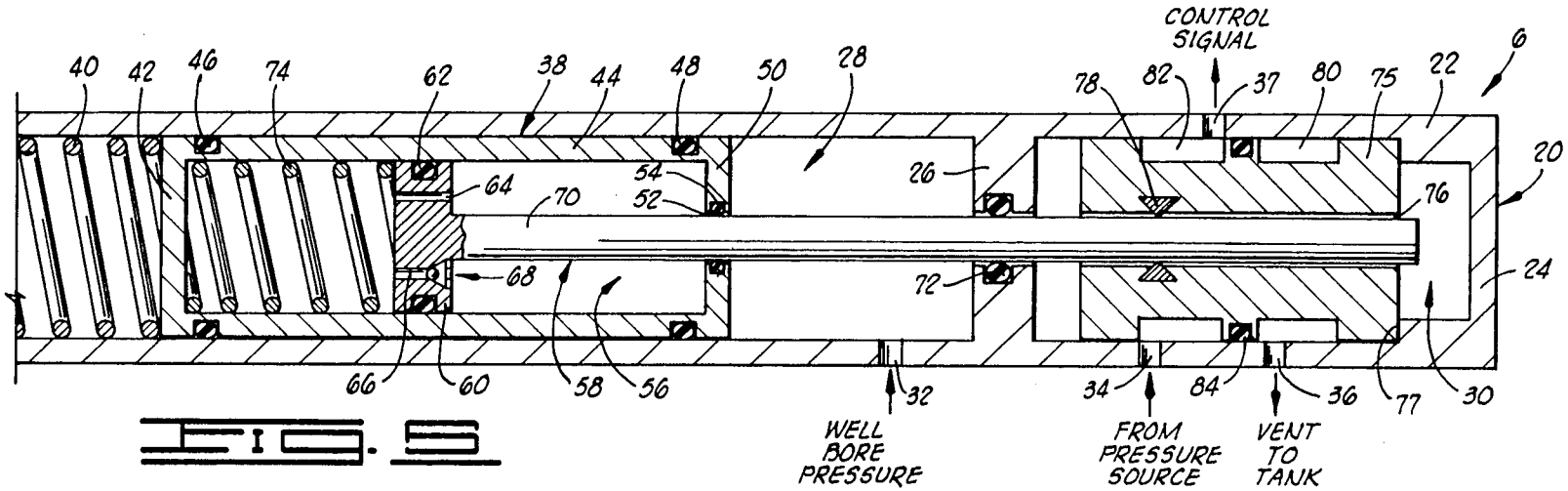
FIG. 5 is a schematic illustration of the apparatus shown at time $t_{1n+1}$ shown in FIG. 2.

A schematic representation of an embodiment implementing the device 6 is shown in different positions in FIGS. 3–5. The structure of the device will be described with reference to FIG. 3. Like parts in FIGS. 4 and 5 are identically numbered.

The embodiment of the device 6 shown in FIG. 3 includes a cylindrical housing 20. The housing 20 includes a cylindrical side wall 22 and a circular end wall 24. Extending radially inwardly from the side wall 22 is an annular wall 26 which separates the interior of the housing 20 into a chamber 28 and a chamber 30. The side wall 22 has a port 32 through which well bore fluid pressure is communicated to the chamber 28. The side wall 22 has ports 34, 36 through which the pressure source 8 and the vent tank 10, respectively, are communicated with the chamber 30. The side wall 22 has a port 37 through which the chamber 30 communicates with the bypass valve 4. The housing 20 is adapted to be disposed in the tubing string in which the bypass valve 4 is connected.

Within the housing 20, the invention broadly includes means for producing a first response to a changing stimulus, means for producing a second response to the stimulus wherein the second response is initially masked by the first response, and means for producing a control signal in response to the second response surpassing the first response. In the illustrated embodiment, the first response is movement in a first direction, and the second response is movement in a second direction. These movements occur at different rates to create a net movement in either the first direction or the second direction. Control occurs when the direction of the net movement switches.

In FIG. 3, the means for producing the first response includes a cylindrical member or sleeve 38 which is slidably disposed for axial or longitudinal movement in the housing 22. The sleeve 38 moves in response to the net force between well pressure and biasing by a spring 40 disposed adjacent an end wall 42 of the member 38. The member 38 also includes a longitudinal, cylindrical side wall 44 which carries seal members 46, 48 fluid tightly sealing against the inner surface of the side wall 22 of the housing 20. Extending perpendicularly from the side wall 44 opposite the end wall 42 is an end wall 50 having an axial opening 52 where a seal 54 is disposed.

The spring 40 is a compression spring which is restrained between the transverse end wall 42 of the member 38 and a suitable support (not shown) of the housing 20.

The slidable member 38 is disposed in the chamber 28 of the housing 20 so that well bore fluid pressure communicated through the port 32 into chamber 28 and the force exerted by the spring 40 act on the member 38 to move the member longitudinally within the chamber 28. One specific function of the spring 40 is to bias the sleeve 38 to a starting position within the housing 20 in response to reduced pressure which occurs in the well bore during a flow period of a drill stem test. The operation will be more fully explained hereinbelow.

The means for producing a second response includes a piston 58 slidably disposed within a chamber 56 of the member 38. The piston 58 includes a cylindrical piston head 60 which carries a seal 62 fluid tightly sealing against the inner surface of the side wall 44 of the member 38. The piston head 62 includes a longitudinal orifice 64 and a longitudinal passageway 66 in which a check valve 68 is disposed. The orifice 64 is an aperture for communicating and metering pressure and fluid across the piston head into a region of the chamber 56 defined between the piston head 60 and the transverse end wall 42 of the sleeve 38.

Extending axially from the piston head 60 is a cylindrical piston stem 70. The stem 70 extends through the opening 52 in the end wall 50 of the sleeve 38 and through the opening in the annular wall 26 of the housing 20. The wall 26 carries a seal 72 for fluid tightly sealing against the piston stem 70. The seal 54 also fluid tightly seals against the piston stem 70.

The piston 58 is moved relative to the cylindrical member or sleeve 38 in response to a biasing force exerted by a compression spring 74 retained between the piston head 60 and the end wall 42 of the member 38. The spring 74 biases the piston 58 to move in an opposite direction from the sleeve 38 as the pressure in the well increases at a decreasing rate of change during a shut-in period of a drill stem test. The biasing force is damped by a fluid contained in the chamber 56 and metered through orifice 64 during movement of the piston 58 within the member 38.

The means for producing a control signal as implemented in the FIG. 3 embodiment includes means, disposed in the housing 20, for communicating a control signal to open the valve 4 in the tubing string in response to the piston 58 moving relative to the sleeve 38 faster than the sleeve 38 is moved relative to the housing 20. These movements occur in response to the net forces resulting from the net pressure/spring forces acting on the sleeve 38 and the piston 58. This communicating means is particularly implemented by a valve 75 disposed within the chamber 30 of the housing 20. The valve 75 has a central opening 76 into which the end of the piston stem 70 extends. Carried adjacent the opening 76 in the body of the valve 75 is a friction engaging member 78 which centers and frictionally engages the piston stem 70. The member 78 permits the piston stem 70 to move independently of the valve 75 when the valve 75 is restrained from moving by end limits defined by the wall 26 and a stop shoulder 77 of the housing 20, but the member 78 exerts a sufficient retaining force on the piston stem 70 so that movement of the piston stem 70 then also moves the valve 75 when the valve 75 is not restrained.

The valve 75 has two longitudinally spaced, circumferential channels 80, 82 between which a sealing member 84 is carried on the valve 75 to fluid tightly seal against the inner surface of the side wall 22 of the housing 20. The channel 80 communicates the ports 36, 37 through a portion of the chamber 30 when the valve 75 is in the position illustrated in FIG. 3. The channel 82 communicates the ports 34, 37 when the valve 75 is in the position illustrated in FIG. 5. As will be more particularly described hereinbelow, the valve 75 is moved from the position shown in FIG. 3 to the position shown in FIG. 5 in response to the spring 74 moving the piston 58 to the right (as oriented in the drawing) faster than the changing well bore fluid pressure moves the sleeve 38 to the left (as oriented in the drawings). That is, the valve 75 is moved to the right when the net movement resulting from the combined movements of the sleeve 38 and the piston 58 changes from the left to the right (as oriented in the drawings).

As previously mentioned, FIGS. 4 and 5 show the same apparatus depicted in FIG. 3, but in different positions. The various positions illustrated will be described further hereinbelow with reference to the operation of the device.

Figure 6:
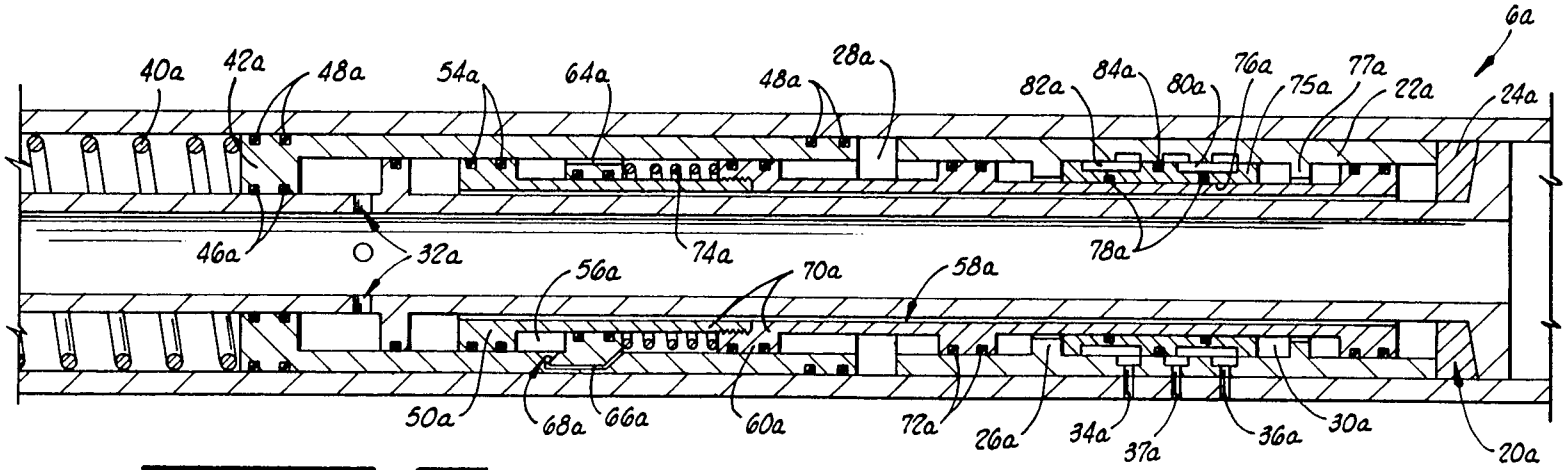
FIG. 6 is an illustration of a preferred embodiment implementing the schematic apparatus illustrated in FIGS. 3–5.

FIG. 6 illustrates a particular implementation of the schematically depicted embodiment of FIGS. 3–5. Elements of the FIG. 6 embodiment corresponding to those of FIGS. 3–5 are marked with the same reference numeral with the addition of the letter "a." Although these corresponding elements may be disposed differently, the particular implementation operates the same.

Operation

The operation of the present invention in controlling the opening of the bypass valve 4 during a drill stem test will be described with reference to the environment shown in FIG. 1, the invention as depicted in FIGS. 3–5 and the pressure cycle of FIG. 2.

To place the present invention in the environment depicted in FIG. 1, the apparatus is connected into a tubing string in a conventional manner and the tubing string is lowered into the well 2 in a conventional manner. The setting of packers and other conventional set up are performed. The drill stem flow and closed-in cycles can then be conducted.

In FIG. 3, the apparatus is shown in the position it would have immediately after time $t_{3n}$ of the cycles represented in FIG. 2. Time $t_{3n}$ is when the bypass valve 4 is closed to close-in the well during the respective drill stem test cycle. Prior to $t_{3n}$ the invention has been reset as follows. Because of the relatively low well bore pressure during the flow period between $t_{1n}$ and $t_{3n}$, the sleeve 38 has been moved to its rightmost position (directions and positions described herein are with reference to the orientation shown in the drawings) in response to the force exerted by the compression spring 40. This movement has also moved the piston 5 to its rightmost position wherein the free end of the stem 70 abuts the end wall 24 as depicted in FIG. 3 by the dot-dash lines. If this abutment occurs before the spring 74 is compressed as fully as it is going to be, the stronger spring 40 will continue to move the member 38 until the spring 74 is so compressed. When this occurs, the system is "cocked" or reset. This resetting occurs after the valve 75 has been moved to the position shown in FIG. 5 so that resetting maintains the valve 75 in its FIG. 5 position, which will be described hereinbelow.

Immediately upon closing the bypass valve 4 at time $t_{3n}$ by using mechanical force controlled from the surface in a known manner, pressure in the well bore rises rapidly. This pressure is communicated through the opening 32 to act against the wall 50 of the sleeve 38 so that it opposes the biasing force of the spring 40. This creates a force differential that moves the sleeve 38 to the left against the spring 40. The immediate effect of this is also to move the piston 58 and the frictionally engaged valve 75 to the left to their respective positions shown in solid line in FIG. 3. This immediate effect releases the control signal pressure from the bypass valve 4 through the thus connected ports 37, 36; this also allows the spring 74 to start moving the piston 58 to the right relative to the sleeve 38 since the stem 70 no longer abuts the end wall 24. This movement is impeded or damped by the metering of the fluid through the orifice 64 so that this rightward movement is initially slower than the leftward movement of the sleeve 38. Thus, the net movement of the system is to the left. This occurs between $t_{3n}$ and $t_{1n+1}$. One position during this period is illustrated in FIG. 4. Because net movement is to the left, the valve 75 remains in its position against stop wall 26 so that the ports 36, 37 continue to communicate through the channel 80. During this phase, the valve 75 is continuously maintained reset as the piston stem 70 slips through the friction engaging member 78. The leftward movement of the sleeve 38 dominates the rightward movement of the piston 58 until the rate of movement of the piston 58 to the right exceeds the rate of movement of the sleeve 38 to the left. This change is intended to occur in the preferred embodiment of the present invention in response to the well bore pressure reaching the steady-state condition. A particular steady-state condition is defined, and thus the shift in the net control response is achieved, by appropriately selecting the sizes and forces of the elements used in assembling a particular embodiment, which determinations can be readily made by those skilled in the art.

Although the pressure in the well continues to increase during this closed-in portion of the drill stem test, the increase occurs at a decreasing rate. This decreasing rate is effectively what is sensed by the illustrated control system to cause the decreasing speed of the leftward movement of the sleeve 38. In particular, as the sleeve 38 moves left, the opposing force of the spring 40 increases and the well bore pressure more slowly increases, resulting in a slowing of the sleeve 38 movement. The piston 58 is meanwhile being moved to the right by the spring 74 at a speed which ultimately exceeds the speed the sleeve 38 moves left. When the system's net direction of movement changes, the piston stem 70 moves to the right at a slow enough rate that the friction engaging member 78 and the attached valve 75 move to the right also, thereby positioning the channel 82 so that the ports 34, 37 communicate. This position is shown in FIG. 5, which illustrates the position of the system at time $t_{1n+1}$. Communicating the port 34 with the port 37 allows the pressure from the pressure source to open the bypass valve 4.

During the drill stem test flow phase which occurs when the bypass valve 4 is opened, the pressure in the well bore decreases (e.g., as shown in FIG. 2 between $t_{1n+1}$ and $t_{2n+1}$) This decrease is sensed by the system through the port 32. The force of the spring 40 ultimately overcomes the pressure, at which time the spring 40 resets the system as previously described.

The foregoing method is then repeated through alternate openings of the bypass valve 4 controlled from the surface and automatic openings of the bypass valve 4 when steady-state conditions are sensed automatically by the present invention. For the preferred embodiment described hereinabove, the closing of the bypass valve 4 initiates two actions leftward movement of the sleeve 38 and rightward movement of the piston 58), but sufficiently large rates of change of the pressure suppress control action. When a sufficiently small rate of change of pressure occurs, however, the controlling action is no longer suppressed so that control occurs (the piston 58 moves the valve 75 to the right). Throughout the process, multiple actions are occurring but at different relative rates. Specifically, there is a race between the movements of the sleeve 38 and the piston 58. When the "leader" of the race changes, a control response occurs.

It is respectfully submitted that this broad concept of the use of relative rates to create control can be implemented in many different ways and yet remain within the scope of the present invention. Presently contemplated races, which are not limiting of the present invention, include chemical reactions, electrical signals, mechanical movement, fluid flow and piezoelectric responses.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A control apparatus responsive to a changing stimulus, comprising:

means for producing a first response to a changing stimulus;

means for producing a second response to said stimulus wherein said second response is of the same type of response as said first response but wherein said first and second responses are of different relative varying degree so that said second response is initially masked by said first response, but so that said second response ultimately surpasses said first response; and means for producing a control signal in response to said second response surpassing said first response.

2. A control apparatus responsive to a changing stimulus, comprising:

means for producing a first response to a changing stimulus wherein said stimulus is well bore pressure changing at a varying rate;

means for producing a second response to said stimulus wherein said second response is initially masked by said first response; and means for producing a control signal in response to said second response surpassing said first response.

3. A control apparatus responsive to a changing stimulus, comprising:

means for producing a first response to a changing stimulus;

means for producing a second response to said stimulus wherein said second response is initially masked by said first response; and means for producing a control signal in response to said second response surpassing said first response;

wherein said first response is movement in a first direction, and said second response is movement in a second direction, said movements occurring at different rates to create a net movement in either said first direction or said second direction.

4. A control apparatus responsive to a changing stimulus, comprising:

means for producing a first response to a changing stimulus;

means for producing a second response to said stimulus wherein said second response is initially masked by said first response; and means for producing a control signal in response to said second response surpassing said first response; wherein;

said means for producing a first response includes a first spring and a first member adjacent said first spring and against which said stimulus acts;

said means for producing a second response includes a second member and a second spring, disposed between said first and second members, said stimulus acting across said second member; and said means for producing a control signal includes a valve connected to said second member, said valve communicating a pressure source as the control signal in response to said second spring moving said second member faster than said stimulus moves said first member.

5. An apparatus as defined in claim 2, wherein said well bore pressure includes well pressure during a shut-in period of a drill stem test, and further wherein said second response surpasses said first response in response to said well pressure reaching a steady-state condition.

6. An apparatus as defined in claim 5, wherein:

said means for producing a first response includes a cylindrical member which moves in response to said well pressure;

said means for producing a second response includes a piston and a spring disposed between said cylindrical member and said piston, wherein said piston moves relative to said cylindrical member in response to said spring and a pressure differential across said piston occurring in response to said well pressure; and said means for producing a control signal includes a valve connected to said piston so that said valve is activated in response to the net movement of said cylindrical member and said piston.

7. An apparatus for controlling the opening of a valve, disposed in a tubing string in a well, during a drill stem test wherein the valve is opened during a flow period of the test and closed during a shut-in period of the test, comprising:

a housing adapted to be disposed in the tubing string;

a first slidable member disposed in said housing;

a second slidable member disposed in said housing;

first biasing means, disposed in said housing, for biasing said first slidable member to a starting position within said housing in response to reduced pressure in the well acting on said first slidable member within said housing during a flow period of a drill stem test;

second biasing means, disposed between said first and second slidable members, for biasing said second slidable member into movement relative to said first slidable member during a shut-in period of a drill stem test; and means, disposed in said housing, for communicating a control signal to open the valve in the tubing string in response to said second slidable member moving relative to said first slidable member faster than said first slidable member is moved relative to said housing by pressure in the well acting on said first slidable member in opposition to said first biasing means.

8. An apparatus as defined in claim 7, wherein:

said first slidable member includes a sleeve having a longitudinal wall and a transverse wall extending from said longitudinal wall;

said second slidable member includes a piston slidably disposed adjacent said sleeve, said piston including a piston head in fluid sealed, slidable relation with said longitudinal wall of said sleeve, and said piston further including a piston stem extending from said piston head, said piston head having an aperture defined therethrough for communicating pressure across said piston head into a region defined between said piston head and said transverse wall of said sleeve; and said means for communicating a control signal includes a valve member connected to said piston stem.

9. An apparatus as defined in claim 8, wherein:

said first biasing means includes a first spring, disposed between said housing and said sleeve; and said second biasing means includes a second spring, disposed between said sleeve and said piston.

10. A method of producing a control response to a changing stimulus, comprising:

producing a first response and a second response wherein there is different relative change between said responses in response to a stimulus changing towards a steady-state condition; and combining said first and second responses into a net control response having at a first time a first state wherein said first response dominates said second response until the stimulus reaches said steady-state condition and having at a second time a second state wherein said second response dominates said first response in response to the stimulus reaching said steady-state condition.

11. A method of producing a control response to a changing stimulus, comprising:

producing a first response and a second response to a stimulus changing towards a steady-state condition; and combining said first and second response into a net control response having at a first time a first state wherein said first response dominates said second response until the stimulus reaches said steady-state condition and having at a second time a second state wherein said second response dominates said first response in response to the stimulus reaching said steady-state condition; wherein:

said first response is movement of a first member in a first direction at a first rate;

said second response is movement of a second member in a second direction at a second rate; and said net control response is the net movement of the combined movements of said first and second responses.

12. A method as defined in claim 11, further comprising performing, within a housing connected to a tubing string disposed in a subterranean well, said movements automatically in response to pressure in the well.

13. A method of producing a control response to a changing stimulus, comprising:

producing a first response and a second response to a stimulus changing towards a steady-state condition; and combining said first and second responses into a net control response having at a first time a first state wherein said first response dominates said second response until the stimulus reaches said steady-state condition and having at a second time a second state wherein said second response dominates said first response in response to the stimulus reaching said steady-state condition; wherein:

said stimulus is fluid pressure; and said step of producing includes moving a member in response to a differential between said fluid pressure and a biasing force acting on said member in opposition to said fluid pressure.

14. A method as defined in claim 13, wherein said step of producing further includes moving a piston, disposed in said member, in response to a damped biasing force acting on said piston.

15. A method of opening a bypass valve during a drill stem test, comprising:

(a) lowering a tubing string into a well, said tubing string including a bypass valve and a housing carrying a first movable member, a second movable member, first biasing means for biasing said first movable member relative to said housing, and second biasing means for biasing said second movable member relative to said first movable member;

(b) closing said bypass valve, whereby pressure in the well increases at a decreasing rate of change;

(c) receiving said increasing pressure into said housing so that said pressure moves said first movable member against said first biasing means at a decreasing speed and so that said second biasing means moves said second movable member opposite said first movable member; and (d) communicating a control signal to open said bypass valve in response to said second movable member moving faster than said first movable member.

16. A method as defined in claim 15, wherein said step (d) includes activating a valve to send a pressure signal to said bypass valve.

17. A method as defined in claim 15, further comprising (e) receiving decreasing pressure from said well into said housing while said bypass valve is open so that said first biasing means moves said first movable member against said decreasing pressure to return said first and second movable members to a starting position before said bypass valve is again closed.

18. A method as defined in claim 17, further comprising manually repeating said step (b) from the surface of said well and automatically repeating said steps (c) through (e) within said well throughout a drill stem test.

* * * * *